United States Patent [19]

Glaesel

[11] 4,050,757

[45] Sept. 27, 1977

[54] INSULATING CASING FOR ELECTRICAL SPADE TERMINAL SOCKETS

[75] Inventor: Gottfried Glaesel, Minusio, Switzerland

[73] Assignee: Hego Electric GmbH, Glarus, Switzerland

[21] Appl. No.: 661,222

[22] Filed: Feb. 25, 1976

[51] Int. Cl.[2] ..... H01R 13/50

[52] U.S. Cl. ..... 339/59 R; 339/213 T; 339/217 S

[58] Field of Search ..... 339/59 R, 59 M, 205, 339/213 R, 213 T, 217 S

[56] References Cited

U.S. PATENT DOCUMENTS

| | | | |
|---|---|---|---|
| 3,430,185 | 2/1969 | Sitzler | 339/59 M |
| 3,689,866 | 9/1972 | Kelly | 339/59 R |
| 3,825,880 | 7/1974 | Battaglia | 339/59 R |

FOREIGN PATENT DOCUMENTS

| | | | |
|---|---|---|---|
| 864,102 | 2/1971 | Canada | 339/59 R |
| 1,952,925 | 6/1971 | Germany | 339/217 S |
| 1,281,009 | 7/1972 | United Kingdom | 339/59 R |

*Primary Examiner*—Roy Lake
*Assistant Examiner*—Mark S. Bicks
*Attorney, Agent, or Firm*—Pollock, Vande Sande & Priddy

[57] ABSTRACT

A push-on insulating sleeve for electrical spade terminal sockets is of symmetrical cross-section so that it can be fitted to a socket in either of two orientations. The socket is located by symmetrical protuberances on the narrow sides at one end of the sleeve, and ratchet teeth spaced from the said end.

2 Claims, 4 Drawing Figures

INSULATING CASING FOR ELECTRICAL SPADE TERMINAL SOCKETS

The present invention relates to an insulating casing for electrical spade terminal sockets, composed of integrally extruded or molded insulating material and capable of being slid from the front on to the spade socket, even after connection of wiring to the latter.

Insulating casings of this kind are known in which a fixed inner rib, disposed in the middle of the inlet opening, guides the spade terminal to the socket in the casing. A front stop preventing the socket from sliding out of the casing is formed by a rib which extends over the entire inside of the other long housing member opposite to the previously mentioned fixed rib. This arrangement assures correct plug-in operation but suffers from the disadvantage that the casing can be slid onto the socket only in a single correct alignment, so that the relative orientation of the socket and casing must be checked by the user. This calls for a substantial amount of time and therefore high costs.

It is therefore an object of the invention to eliminate the above-mentioned disadvantage and to construct a casing for spade terminal sockets in such a way that the casing can be slid on to the spade sockets from the front without the need for correct orientation.

According to the invention, the front stop in the insulating casing for the inserted spade socket is formed merely by two protuberances which project symmetrically from the narrow sides into the internal space of the casing, and the rear stop is formed by two symmetrically arranged ratchet teeth, so that the insulating casing can be slid over the spade socket from the front in either one of two orientations which are offset from each other by 180°.

Preferably, symmetrically disposed noses are provided on two oppositely disposed longitudinal sides within the casing at the spade insertion end, to reliably avoid incorrect insertion. To improve handling, the rear part of the casing can be constructed as a grip or handle, for example it can be provided with knurling or the like.

Figure 1:
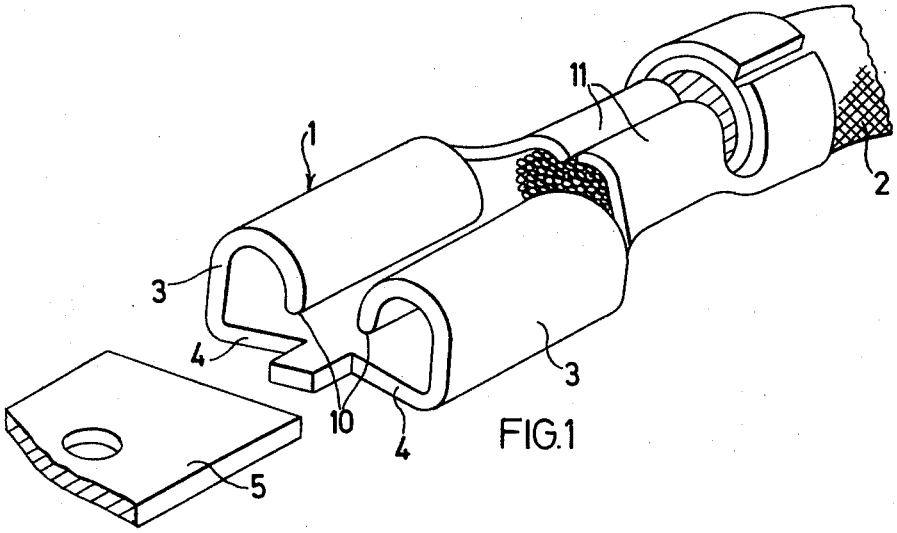
Figure 2:
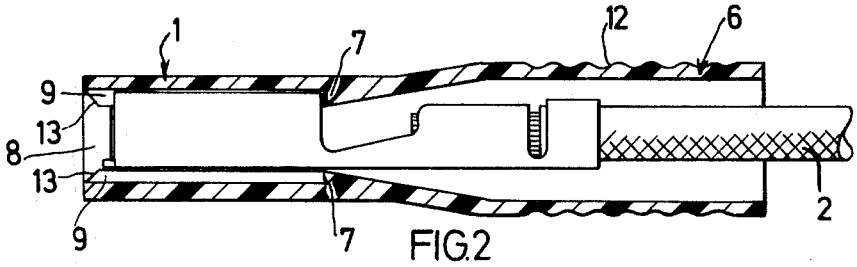
Figure 3:
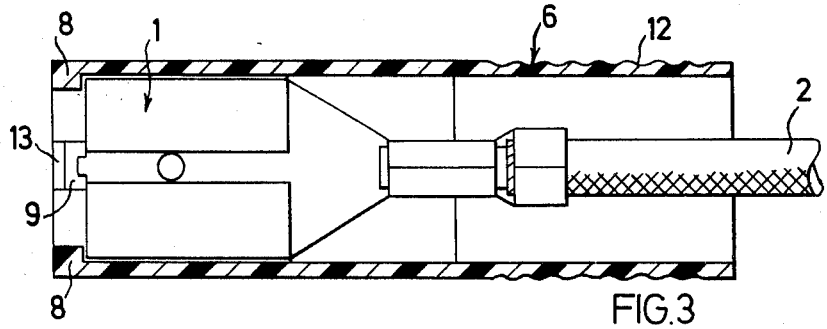
Figure 4:
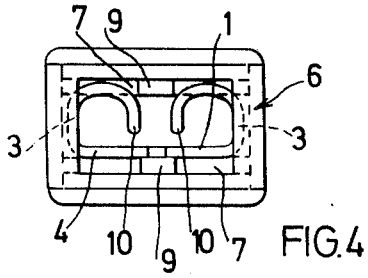

One embodiment of the insulating casing according to the invention is illustrated in the accompanying drawing, in which:

FIG. 1 is a view of a conventional spade socket connected to a conductor but without an insulating casing, FIG. 2 shows a sectional side view of an insulating casing fitted on the spade socket, FIG. 3 shows a sectional plan view of the insulating casing fitted on the spade socket, and FIG. 4 shows a front view of the insulating casing and socket.

The conventional spade terminal socket 1, shown more particularly in FIG. 1, comprises flat metal strip or sheet stock bent so that the socket has a flat middle web 4 with upstanding flanges 3 at the sides, which flanges are curved inwardly through 180° to form gripping edges 10 facing and spaced from the web 4. In use, a flat connecting terminal spade 5 is resiliently gripped between the web 4 and the edges 10 of the bent flanges 3. A conductor 2 is usually clamped to the rear of the metal socket member by tabs 11.

FIGS. 2 to 4 show an insulating casing 6 for the socket.

The casing is a tube of rectangular cross-section made of extruded or molded resilient electrically insulating plastic material. One end (the left hand end in FIG. 2) is slightly thinner overall than the other end and the latter, i.e., thicker end has a roughened, for example ribbed or knurled surface 12 for gripping manualy. The first-mentioned end region has, on each of the larger internal faces, a central longitudinally extending rib 9. At the inner end of each rib, an asymmetrical tooth 7 extends across each of the wider internal faces, the steeper face of the tooth facing the nearer end of the casing, i.e. the left hand end in FIGS. 2 and 3. At the said end, a stop protuberance 8 extends inwards from each of the narrower internal faces of the casing.

The internal dimensions of the thinner end of the casing correspond to those of the socket 1 in such a way that the socket can lie inside the thinner end of the casing with the web 4 resting on one rib 9 and the bent flanges 3 on opposite sides of the other rib 9 and adjacent to the surface with which the latter rib is integral, the laterally outermost parts of the ends of the flanges 3 abutting on the protuberances 8 to retain the socket in the casing. The other end of the socket is retained by one of the teeth 7 engaging the ends of the curved regions of the flanges, as shown in FIG. 2. Because the material of the casing is resilient, the socket can be slid into the casing from the right hand end (in FIGS. 2 and 3) even after a conductor has been connected to the socket. The teeth will move apart as the socket is inserted and will then snap back behind the socket flanges.

At the end through which the spade 5 is inserted, the web 4 and the gripping edges 10 are exposed, only the laterally outermost parts of the socket being obscured by the protuberances 8, so that the spade can enter a socket in either orientation. The ribs 9 have chamfered ends 13 to guide the spade into the socket (or the socket onto the spade).

Since the casing is of symmetrical construction, it can be fitted to the socket in either orientation.

I claim:

1. An insulating casing for an electrical spade terminal socket of the kind having a web and inwardly bent lateral gripping portions laterally spaced from one another, said casing consisting of an integral body of insulating material adapted to be slid over a said socket from the front end of the latter, the casing being of substantially rectangular cross-section having two opposite narrow sides and two opposite broad sides, front end stop means for the socket at the front end of the casing formed solely by two protuberances which project symmetrically into the internal space of the casing from the narrow sides thereof, rear stop means spaced from said front end end formed by two symmetrically disposed ratchet teeth projecting into the internal space of the casing from respective broad sides thereof for engaging the rear ends of said gripping portions of an inserted spade terminal socket, a rib on the internal surface of each said broad side extending along the longitudinal center line of the said broad side for supporting the web portion of an inserted spade terminal socket, said ribs and said teeth projecting from each said broad side into the internal space of the casing for substantially equal distances, and symmetrically disposed noses on both broad sides in the casing at the front end thereof for guiding a spade terminal into the socket, whereby the casing can be slid over a spade terminal socket from the front of the latter in either one of two orientations which are offset by 180° with respect to each other.

2. An insulating casing according to claim 1, wherein the rear part of the casing is constructed as a handle.

* * * * *